US011399565B2

(12) United States Patent
Esposti et al.

(10) Patent No.: US 11,399,565 B2
(45) Date of Patent: Aug. 2, 2022

(54) FILLING UNIT FOR FILLING A SUCCESSION OF TUBULAR WRAPPERS OF THE TOBACCO INDUSTRY

(71) Applicant: G.D S.P.A., Bologna (IT)

(72) Inventors: Marco Esposti, Casalecchio di Reno (IT); Ivan Eusepi, Castelmaggiore (IT); Gabriele Benni, Sasso Marconi (IT); Giuliano Gamberini, Crevalcore (IT); Massimo Sartoni, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 172 days.

(21) Appl. No.: 16/979,018

(22) PCT Filed: Mar. 12, 2019

(86) PCT No.: PCT/IB2019/051987
§ 371 (c)(1),
(2) Date: Sep. 8, 2020

(87) PCT Pub. No.: WO2019/175762
PCT Pub. Date: Sep. 19, 2019

(65) Prior Publication Data

US 2021/0360961 A1 Nov. 25, 2021

(30) Foreign Application Priority Data

Mar. 13, 2018 (IT) ..... 102018000003495

(51) Int. Cl.
*A24C 5/32* (2006.01)
*A24D 3/02* (2006.01)
(Continued)

(52) U.S. Cl.
CPC ..... *A24D 3/0225* (2013.01); *A24C 5/04* (2013.01); *A24C 5/24* (2013.01); *A24C 5/28* (2013.01);
(Continued)

(58) Field of Classification Search
CPC .... A24C 5/02; A24C 5/24; A24C 5/28; A24C 5/327; A24C 5/343; A24C 5/54
See application file for complete search history.

(56) References Cited

U.S. PATENT DOCUMENTS 1,164,118 A 12/1915 Rogier

FOREIGN PATENT DOCUMENTS

CH 407856 A 2/1966
EP 2921414 A1 9/2015

OTHER PUBLICATIONS

European Search Report dated Apr. 8, 2022 from counterpart European Patent Application No. 21210820.3.
(Continued)

*Primary Examiner* — Eric Yaary
(74) *Attorney, Agent, or Firm* — Shuttleworth & Ingersoll, PLC; Timothy J. Klima

(57) ABSTRACT

A filling unit, configured to fill a succession of tubular wrappers of the tobacco industry. The tubular wrappers extend along a main axis of extension and internally define respective containment chambers adapted to contain a filling material of the tobacco industry and have an access opening on at least one of its ends for access to the containment chamber. The unit also includes a filling station configured to insert the filling material into respective containment chambers of the succession of tubular wrappers through a filling end of them and a closing station disposed downstream of the filling station and comprising a plurality of closing means configured to make respective walls which
(Continued)

close the filling ends and which are transverse to the respective main axes of extension.

25 Claims, 4 Drawing Sheets

(51) Int. Cl.

| | |
|---|---|
| ***A24C 5/04*** | (2006.01) |
| ***A24C 5/24*** | (2006.01) |
| ***A24C 5/28*** | (2006.01) |
| ***A24C 5/343*** | (2006.01) |
| *A24D 1/22* | (2020.01) |

(52) U.S. Cl.
CPC ..... *A24C 5/327* (2013.01); *A24C 5/343* (2013.01); *A24D 1/22* (2020.01)

(56) References Cited

OTHER PUBLICATIONS

International Search Report and Written Opinion dated Jul. 5, 2019 from counterpart International Patent Application No. PCT/IB2018/041987.

FILLING UNIT FOR FILLING A SUCCESSION OF TUBULAR WRAPPERS OF THE TOBACCO INDUSTRY

This application is the National Phase of International Application PCT/IB2019/051987 filed Mar. 12, 2019 which designated the U.S.

This application claims priority to Italian Patent Application No. 102018000003495 filed Mar. 13, 2018, which applications are incorporated by reference herein.

TECHNICAL FIELD

This invention relates to the field of machines for making articles of the tobacco industry.

BACKGROUND ART

More specifically, this invention relates to a filling unit for filling a succession of tubular wrappers of the tobacco industry, specifically for making sub-units of a smoking article, especially of the heat not burn (HNB) type or electronic cigarettes.

That type of article may be inhaled by heating but not burning the active portion.

The active portion may in fact be a segment comprising an aerosol-generating element, or a heat-not-burn type tobacco containing product.

In this case the tobacco may be for example of the type which is pre-treated, reconstituted, homogenized, or cast leaf, which in particular takes the form of loose material such as pellets or is in the form of a crimped ribbon.

However, in this context, in order to be able to ensure the quality of the finished product, it is important to guarantee that the filling material making up the active portion is correctly contained and retained both during and after the production process.

Prior art production methods involve making a smoking article formed by a rod-shaped body (for example a filter or a heating element) and a tubular wrapper which is then filled with the aerosol-generating element.

However, that solution is not very suitable for guaranteeing the integrity of the article, in particular because it does not allow ensuring that the active portion will be correctly retained in the tubular body.

In effect, prior art machines known in this field allow the filling material to be filled into the tubular wrapper but do not have any checking mechanisms to ensure that it remains inside.

This aspect creates the need for onerous procedures to remove defective, non-conforming products which have lost a large part of the filling material that had been placed inside them.

DISCLOSURE OF THE INVENTION

In this context, the technical purpose which forms the basis of the present invention is to propose a filling unit which overcomes at least some of the above mentioned disadvantages of the prior art.

More specifically, this invention has for an aim to provide a filling unit capable of allowing the articles to be correctly processed and handled during production, while at the same time eliminating the risk of losing the filling material and, more generally damaging and/or deteriorating the product.

The technical purpose indicated and the aims specified are substantially achieved by a filling unit comprising the technical features described in one or more of the accompanying claims.

This invention discloses a filling unit configured to fill a succession of tubular wrappers of the tobacco industry.

The tubular wrappers extend along a main axis of extension, internally define respective containment chambers adapted to contain a filling material of the tobacco industry and have an access opening on at least one of its ends for access to the containment chamber.

The unit comprises a filling station configured to insert the filling material into respective containment chambers of the succession of tubular wrappers through a filling end of them and a closing station disposed downstream of the filling station and comprising a plurality of closing means configured to make respective walls which close the filling ends and which are transverse to the respective main axes of extension.

Advantageously, this solution ensures that the filling material is correctly contained in the tubular wrapper, eliminating the obviously unwanted risk of the material accidentally falling out.

Another object of the invention is to provide a filling machine of the tobacco industry which comprises a filling unit of the tobacco industry and a forming station, located upstream of the filling unit, configured to make the succession of tubular wrappers.

Advantageously, the machine of this invention provides an efficient and high-performing solution for making components used in the production of smoking articles.

The dependent claims, which are incorporated herein by reference, correspond to different embodiments of the invention.

BRIEF DESCRIPTION OF THE DRAWINGS

Further features and advantages of the present invention are more apparent in the detailed description below, with reference to a preferred, but non-exclusive, embodiment of a filling unit, as illustrated in the accompanying drawings, in which.

DETAILED DESCRIPTION OF PREFERRED EMBODIMENTS OF THE INVENTION

The numeral 10 in the accompanying drawings denotes in its entirety a filling unit of the tobacco industry.

The unit 10 is fed with a succession of tubular wrappers "T" of the tobacco industry, which extend along a main axis of extension "X" and which internally define respective containment chambers.

The containment chambers are adapted to contain a filling material of the tobacco industry and each of them has an access opening on at least one of its ends to allow the filling material to be inserted into it.

By way of a non-limiting example, the filling material may be an aerosol-generating material, tobacco pellets, tobacco which is loose or in another form, flavouring material (for example micro-capsules containing a flavouring liquid) or filtering material (activated charcoal, silica gel or others known in the reference sector) or even a material with cooling effect (such as PLA pellets).

Looking in more detail, each tubular wrapper "T" fed into the filling unit 10 has a filling end, into which the filling material is inserted, and a blocking end, opposite to the filling end.

Figure 1:
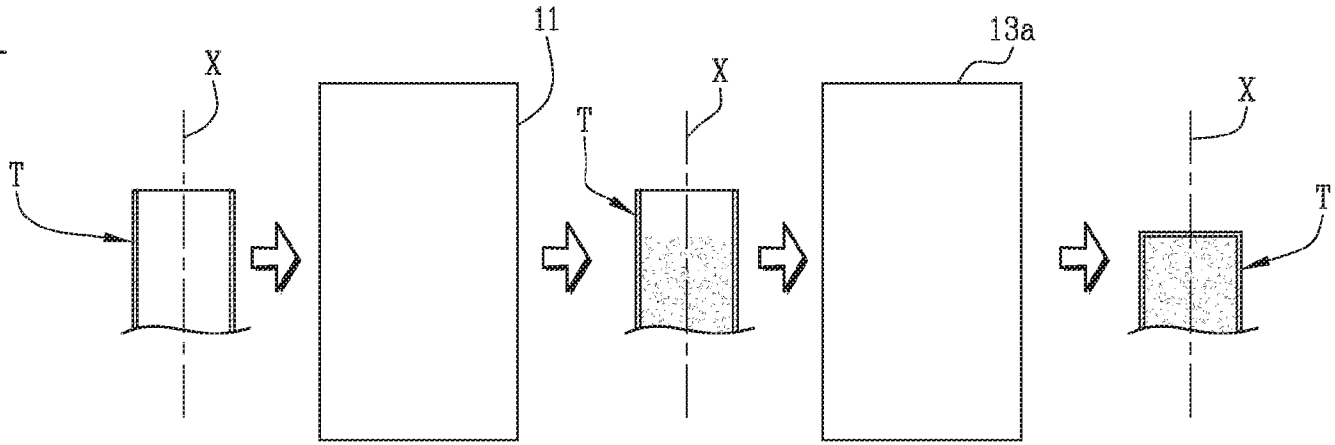
FIG. 1 schematically shows a filling unit of the tobacco industry according to this invention.

As shown in FIG. 1, the filling unit 10 comprises a filling station 11 and a closing station 13*a*.

The filling station 11 comprises a plurality of filling means 12 configured to insert the filling material into the containment chambers of the succession of tubular wrappers "T" processed by the filling unit.

As stated above, the filling material is inserted through the filling end of the tubular wrappers "T".

The closing station 13*a* is disposed downstream of the filling station 11 and comprises a plurality of closing means 14 which are configured to make respective walls which close the filling ends and which are transverse to the respective main axes of extension "X".

In other words, when the tubular wrapper "T" reaches the filling unit 10, the filling station 11 first inserts the filling material into it to fill it and the closing station 13*a* then forms a wall to close the filling end by blocking the access opening to prevent the filling material from falling out during subsequent processing.

It is also evident that in order to ensure properly containing the filling material, the blocking end must also be provided with a closing wall.

In a first possible embodiment, the filling unit 10 is configured to receive tubular wrappers whose blocking ends are not provided with the access opening; in other words, when the tubular wrappers are fed in, they are already provided with a closing wall which prevents the filling material from passing through.

Alternatively, the blocking end might also be provided with an access opening when the tubular wrapper is fed to the filling unit 10.

Figure 2:
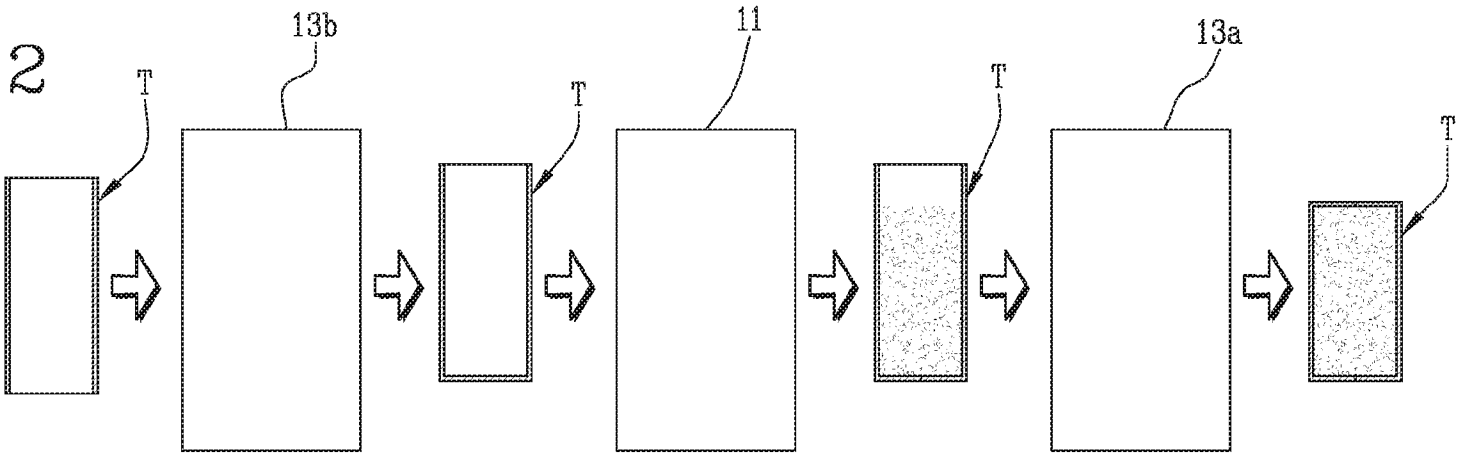
FIG. 2 shows a further possible configuration of the filling unit according to this invention.

In such a case, as shown in more detail in FIG. 2, the filling unit 10 comprises a further closing station 13*b*, disposed upstream of the filling station and in turn comprising a plurality of closing means 14, configured to make a wall, transverse to the main axis of extension "X", for closing the respective blocking ends of the succession of tubular wrappers.

In both cases, it may be noted that the blocking end is provided with a suitable closing wall.

Whether made upstream of the point where the tubular wrapper is fed into the filling unit 10 or made by the further closing station 13*b*, this closing wall provides an abutment surface for the filling material during the operation by which the tubular wrapper "T" is filled.

In other words, each tubular wrapper "T" fed to the filling station 11 has a single access opening, at the filling end of it, whilst the blocking end has a closing wall which allows blocking the filling material to prevent it from falling out during the filling process.

The closing stations 13*a*, 13*b* each comprise at least one feed drum which in turn comprises a fixed cam and on which the plurality of closing means 14 are mounted.

The closing means 14 each comprise a drive rod which is slidable in a respective linear guide and which is engaged with the fixed cam in such a way that as the feed drum rotates, the cam mechanism causes a to-and-fro translational movement of the closing means 14 along a direction parallel to the main axis of extension "X" of the succession of tubular wrappers "T" as they pass through the respective closing station 13*a*, 13*b*.

Similarly, the filling station 11 comprises at least one feed drum which in turn comprises a fixed cam and on which the plurality of filling means 12 are mounted.

The filling means 12 each comprise a drive rod which is slidable in a respective linear guide and which is engaged with the fixed cam in such a way that as the feed drum rotates, the cam mechanism causes a to-and-fro translational movement of the filling means 12 along a direction parallel to the main axis of extension "X" of the succession of tubular wrappers "T" as they pass through the filling station 11.

In other words, the closing means 14 and the filling means 12 move towards the tubular wrapper "T" along a trajectory defined by the cam mechanism as it passes through the filling unit 10 and each engages the wrapper to perform its function, which, in the case of the filling means 12, is to insert the filling material and, in the case of the closing means 14, is to make the closing wall. In alternative embodiments, the cam mechanism may be replaced by pneumatic actuators or electric actuators.

Next, the cam mechanism causes the closing means 14 and the filling means 12 to move away from the tubular wrapper "T" which they have operated on.

Figure 3:
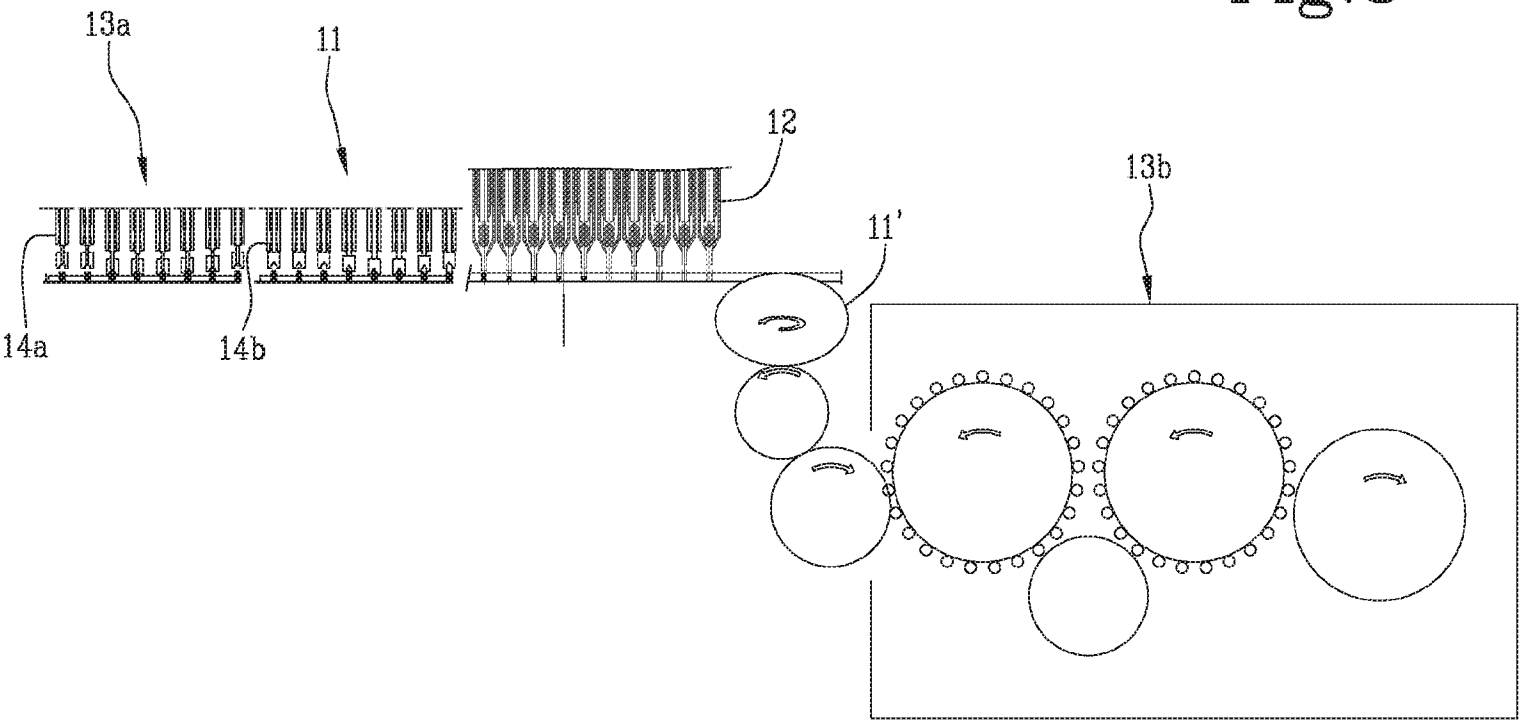
FIG. 3 shows in more detail a possible structural configuration of the filling unit according to this invention.

According to one particular aspect of this invention, shown in particular in FIG. 3, the filling unit 10 comprises two closing stations 13*a*, 13*b* and one filling station 11 interposed between them.

The closing station 13*b*, located upstream of the filling station 11, receives the succession of tubular wrappers "T", each of which is fed to it with the main axis of extension "X" disposed horizontally.

The rotation of the feed drum of the closing station 13*b* causes its closing means 14 to move progressively closer to the blocking ends of the tubular wrappers "T" until engaging them in such a way as to make, in each one, a closing wall transverse to the main axis of extension "X".

It should be noted that inserting the filling material when the tubular wrappers "T" are disposed horizontally might lead to some complications.

In this case, therefore, the filling station 11 comprises a tapered transfer drum 11' configured to transfer the tubular wrappers "T" between the closing station 13*b* and the filling station 11 in such a way as to place them in a vertical position with the filling end facing up.

The rotation of the feed drum of the filling station 11 causes its filling means 12 to move progressively closer to the filling ends of the tubular wrappers "T" until engaging them in such a way as to allow the filling material to be inserted into each.

Lastly, the tubular wrappers reach the closing station 13*a* located downstream of the filling station 11 and the rotation of the feed drum of the closing station 13*a* causes its closing means 14 to move progressively closer to the filling ends of the tubular wrappers "T" until engaging them in such a way as to make, in each one, a closing wall transverse to the main axis of extension "X".

In a first possible embodiment, at least one closing station 13*a*, 13*b* is configured to fold respective filling or blocking ends of the succession of tubular wrappers "T" in such a way as to make respective closing walls.

In other words, the filling unit 10 allows making tubular wrappers "T" in which at least one between the filling end and the blocking end has a closing wall defined by folding an end portion of the respective end.

The closing means 14 might also act in conjunction with rotary movement means (not illustrated) adapted to make the closing means 14 rotate about the main axis of extension "X". That way, in use, the closing wall of the tubular wrappers "T" is reinforced by the folding action imparted by the rotation.

Figures 4A, 4B, 4C:
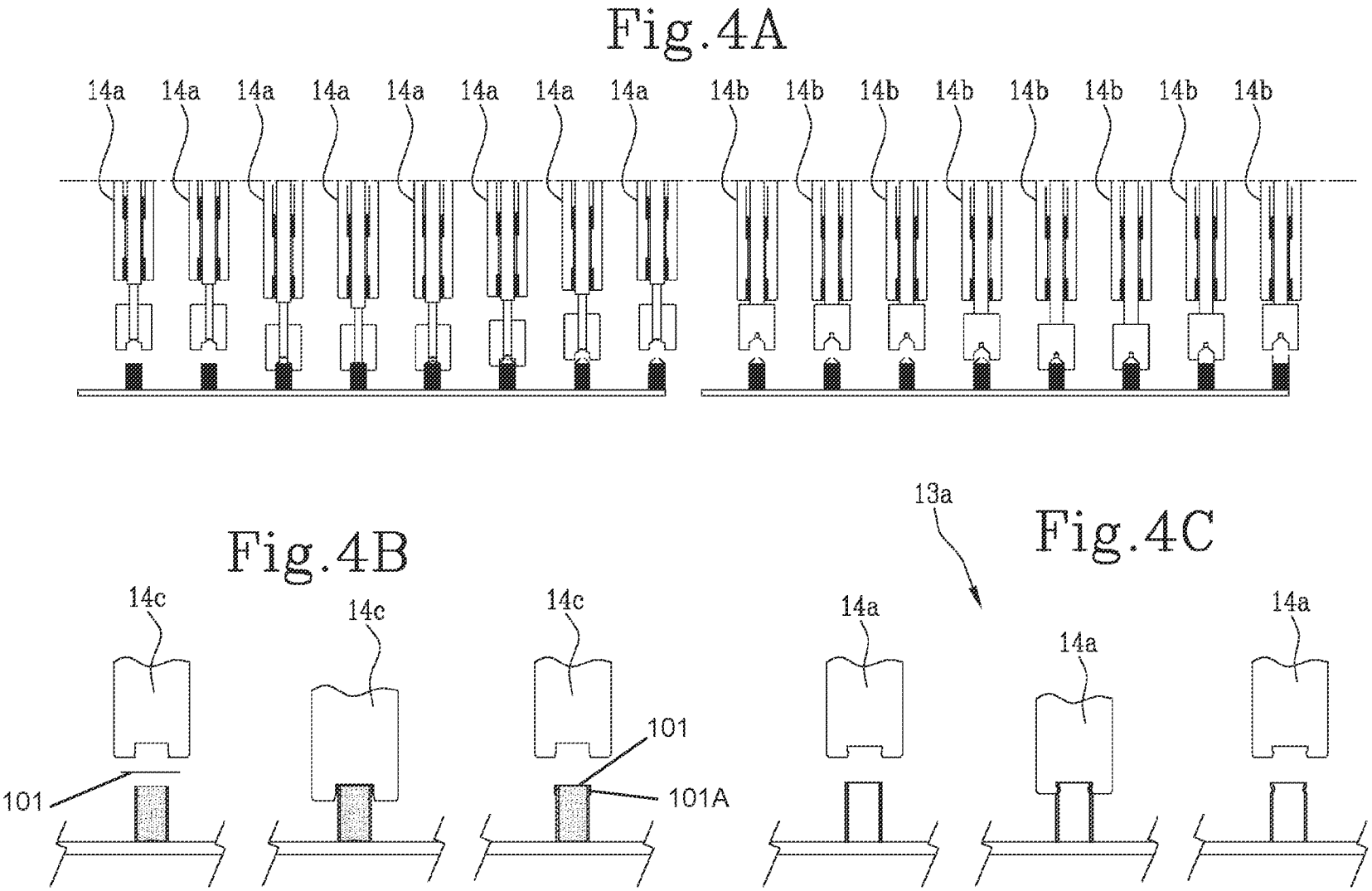
FIG. 4A shows a possible embodiment of a closing station in a filling unit of the tobacco industry.
FIG. 4B is a detail view showing a further possible embodiment of the closing means of a closing station in a filling unit of the tobacco industry.
FIG. 4C is a detail view showing a further possible embodiment of the closing means of a closing station in a filling unit of the tobacco industry.

The plurality of closing means 14 of each closing station 13*a*, 13*b* responsible for making this type of closing wall comprises a plurality of forming means 14A, shown in FIG. 4A, configured to apply on respective filling or blocking ends a pressure whereby an end portion of the respective ends is mechanically deformed permanently in such a way as to make the closing walls.

In other words, the forming means 14*a* act on one end of the tubular wrapper "T" in such a way as to fold it gradually by pressing it substantially coaxially with main axis of extension "X" to make its closing wall.

The plurality of closing means may also comprise a plurality of pre-forming means 14*b*, disposed upstream of the plurality of forming means 14*a* and configured to apply a pressure on the respective filling or blocking ends in such a way as to permanently deform them to make a plurality of easy fold lines disposed radially around the main axis of extension "X".

In other words, the pre-forming means 14*b*, also shown in FIG. 4A, permanently pre-form the end of the tubular wrapper "T" in such a way as to make a plurality of easy fold lines disposed radially around the main axis of extension "X" and suitable for allowing final forming and closure at a subsequent stage.

The pre-forming means 14*b* and the forming means 14*a* may be mounted on the same feed drum or on separate but contiguous feed drums.

This structural feature allows dividing the process of making the closing walls of each tubular wrapper "T" into two successive steps: in a first step, carried out by the preforming means 14*b*, the terminal portion of the end being processed is deformed a first time to make the easy fold lines; in a second step, carried out by the forming means 14*a*, the process of making the closing wall is completed by deforming along the easy fold lines the terminal portion of the end being processed.

Advantageously, it is therefore possible to modify the structure and geometry of the preforming means 14*b* to obtain different easy fold lines to make differently shaped closing walls.

It is also possible for both of the closing stations 13*a*, 13*b*, if present, to be configured to fold the filling end and the blocking end of the tubular wrapper "T", respectively, thereby making respective closing walls which are transverse to the main axis of extension "X".

In a further possible embodiment, at least one closing station 13*a*, 13*b* is configured to apply a closing element 101 to respective filling or blocking ends of the succession of tubular wrappers "T" in such a way as to make the respective closing walls.

In other words, the filling unit 10 allows making tubular wrappers "T" in which at least one between the filling end and the blocking end has a closing element 101 applied to the end in such a way as to define the closing wall, as shown in FIG. 4B.

In this embodiment, the plurality of closing means 14 comprises a plurality of applicator means 14*c* configured to apply a closing element 101 on respective filling or blocking ends.

The closing element 101 extends transversely to the main axis of extension "X" in such a way as to at least partly close the access opening.

The closing element 101 may have a substantially circular profile, that is to say, a profile which substantially follows that of the tubular wrapper, which also preferably has a substantially circular profile.

Alternatively, the closing element 101 has a substantially square profile.

Preferably, the closing element 101 is made of a flame retardant material and, still more preferably, the closing element is made of a metallic or metallized material making it resistant to burning.

According to a first aspect of the embodiment described here (but not illustrated), the applicator means 14*c* are configured to insert the closing element inside the tubular wrapper "T".

In other words, using the applicator means 14*c*, the closing element 101 is placed inside the tubular wrapper "T" and coupled to an inside surface thereof.

Preferably, the closing element 101 also comprises at least one edge portion by means of which the closing element 101 is coupled to the tubular wrapper "T".

In particular, the closing element 101 is connected to an inside wall of the end of the tubular wrapper "T" by interference with the edge portion.

In other words, once inserted into the containment chamber, the closing element is deformed in such a way that its edge portion is pressed against the inside wall of the end into which the closing element is inserted by the applicator means 14*c* and the friction between the two prevents it from slipping out.

Alternatively, the closing element 101 may be coupled to the tubular wrapper by gluing the edge portion 101*a* to an inside wall of the end of the tubular wrapper "T" (embodiment not illustrated).

According to a second aspect of the embodiment described here and illustrated in FIG. 4B, the applicator means 14*c* are configured to apply the closing element on the outside of the tubular wrapper "T".

In this case too, the closing element 101 has at least one edge portion 101*a* used for fixedly coupling the closing element to the end of the tubular wrapper "T".

In particular, the closing element 101 may be coupled to the tubular wrapper "T" by gluing the edge portion 101*a* to an outside wall of the respective end (embodiment illustrated in FIG. 4B).

For this purpose, the applicator means 14*c* are also configured to apply a gummed layer at least to the edge portion 101*a* of the closing element 101 or are configured to apply a connecting strip to fixedly attach the closing element 101 to the tubular wrapper "T".

It is also possible for both of the closing stations 13*a*, 13*b*, if present, to be configured to apply the closing element 101 to the filling end and to the blocking end of the tubular wrapper "T", respectively, thereby making respective closing walls which are transverse to the main axis of extension "X".

In a further possible embodiment, at least one closing station 13*a*, 13*b* is configured to deform a respective end of the tubular wrapper "T" and to apply a closing element on that end of the tubular wrapper "T" in such a way as to make the closing wall.

More specifically, in this embodiment, the closing means 14 comprise a plurality of applicator means 14*c*, configured to apply a closing element to respective filling or blocking ends, and a plurality of forming means 14*a*, shown in detail in FIG. 4C, configured to apply on respective filling or blocking ends a pressure whereby an end portion of the respective ends is mechanically deformed.

The step of mechanically deforming allows making at least one blocking portion, located inside the ends and extending transversely to the main axis of extension "X", to define a blocking surface for blocking the closing element at a predetermined position.

In other words, in this embodiment, the filling unit 10 allows making tubular wrappers "T" in which at least one between the filling end and the blocking end has a closing wall defined by a closing element which is fixedly connected to the tubular wrapper "T" by at least one blocking portion made by folding an end portion of the respective end.

More specifically, the at least one blocking portion is defined by a permanent deformation of the respective end in which the blocking portion is made.

More specifically, the at least one blocking portion may be made in the form of an annular ridge or narrowing on an inside surface of the respective end or in the form of an edge bead on a terminal portion of the respective end.

The term "narrowing" is used to refer to the result of a mechanical process by which the tubular wrapper "T" is circumferentially deformed to give it a cross-section with reduced diameter.

In other words, the outside wall of the tubular wrapper "T" is flattened along an annular circular path in such a way that this outside wall defines a recess.

The term edge bead is used to refer to a mechanical process by which an end portion of a respective end of the tubular wrapper "T" is folded over itself, in such a way that it comes into abutment with an inside wall of the tubular wrapper "T" itself.

Preferably, the plurality of forming means 14*a* comprise first forming means, disposed upstream of the plurality of applicator means 14*c* and configured to make a first blocking portion, and second forming means, disposed downstream of the plurality of applicator means 14*c* and configured to make a second blocking portion.

As a result, each end of the tubular wrapper "T" has a pair of blocking portions and the closing element is interposed between the blocking portions and blocked between them in a configuration of at least partial closure of the access opening.

Preferably, the first blocking portion, which, in the finished product, is interposed between the filling material and the closing element, is defined by a narrowing of the tubular wrapper "T", while the second blocking portion, which, in the finished product, is interposed between the closing element and the outside atmosphere, is defined by an edge bead of the tubular wrapper "T".

That is to say that the forming means are preferably configured to make a narrowing on the tubular wrapper "T", thus defining a blocking portion which serves as a base for supporting the closing element subsequently inserted into the tubular wrapper "T" by the applicator means 14*c*.

Once the closing element has been applied, the second forming means make an edge bead on the tubular wrapper "T" to define a blocking portion which prevents the closing element from falling out and ensures that it is held correctly in place.

It is also possible for both of the closing stations 13*a*, 13*b*, if present, to be configured to deform the filling end and the blocking end of the tubular wrapper "T", respectively, and to apply a closing element to each end, thereby making respective closing walls which are transverse to the main axis of extension "X".

It is also possible for the closing station 13*a* to be made according to one of the embodiments described above and the further closing station 13*b* to be made according to a different embodiment.

In other words, the different types of closing stations 13*a*, 13*b* described above can be combined according to the specific features of the product to be made or simply to better adapt them to the features of the production line in which the filling unit 10 is installed.

Advantageously, this unit achieves the preset aims and overcomes the disadvantages of the prior art by providing the user with a device which can ensure that the filling material will be correctly held within the tubular wrapper "T", while making a wide range of high-quality products adaptable to the needs of the production line.

Another object of the invention is to provide a filling machine 100 of the tobacco industry configured to make tubular wrappers "T" and to insert filling material into them.

The machine 100 comprises a filling unit 10 made as described above and a forming unit 20.

The forming unit 20 is disposed upstream of the filling unit 10 and is configured to make the succession of tubular wrappers "T" that will subsequently be fed to the filling unit 10.

Each tubular wrapper "T" may be made using different tubular shaped elements of the tobacco industry.

The forming unit 20 is therefore configured to receive and process a wide range of wrapping materials, commonly used in the tobacco industry, to make the succession of tubular wrappers "T".

Preferably, these wrapping materials are at least partly metallic or metallized: that is to say, they comprise metallic particles intended to make the tubular wrappers "T" unsuitable for combustion.

In a first possible embodiment, the forming unit 20 is configured to receive a continuous tubular rod fed to it and comprises cutting means operating on the tubular rod to divide it into the succession of tubular wrappers "T".

In a further possible embodiment, the forming unit 20 is configured to receive a continuous web "N" of wrapping material fed to it and comprises a forming beam configured to progressively wrap the continuous web "N" to define a continuous rod and cutting means operating on the continuous rod to divide it into the succession of tubular wrappers "T".

In a further possible embodiment, the forming unit 20 is configured to receive a succession of tubular wrappers T having an access opening at the filling end and a closing wall at the blocking end.

The forming unit 20 comprises a plurality of transfer drums configured to feed the succession of tubular wrappers "T" to the filling unit 10.

Figure 5:
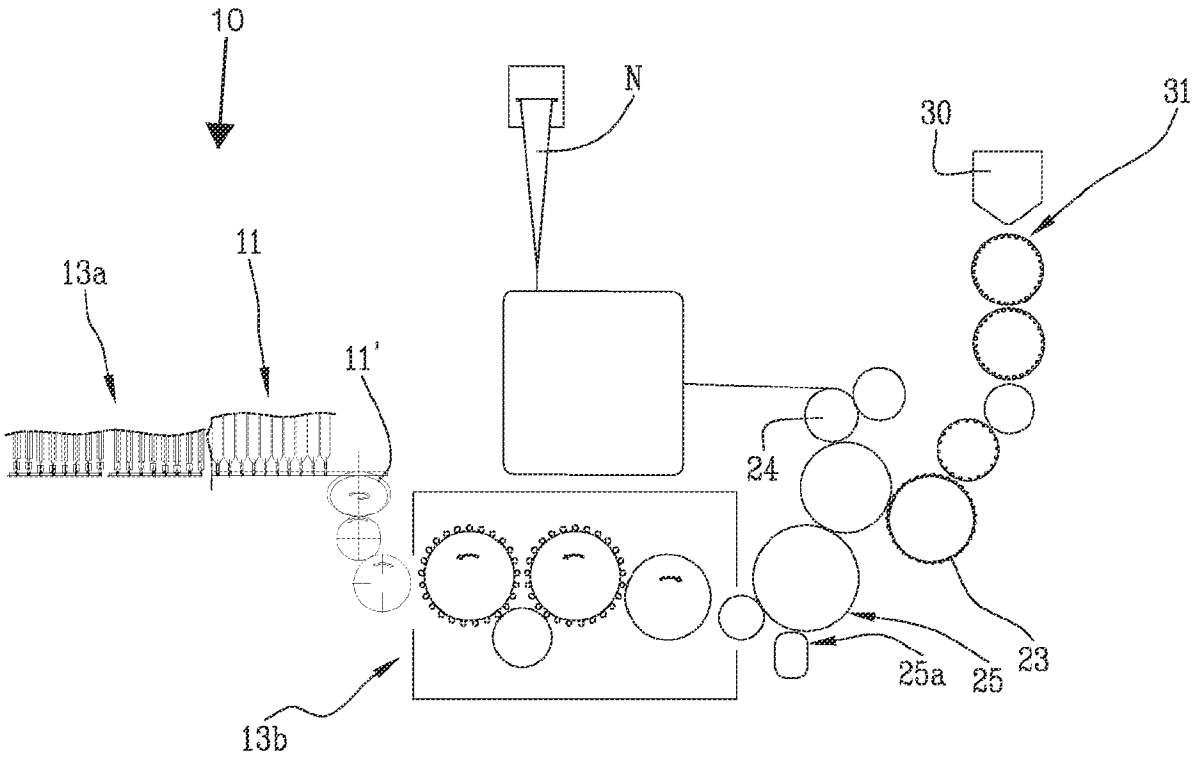
FIG. 5 shows in more detail a possible structural configuration of a filling machine of the tobacco industry according to this invention.

In a further possible embodiment, shown in detail in FIG. 5, the machine 100 is configured to receive a plurality of tubular segments and to process them by wrapping them in respective connecting strips of wrapping material made by cutting a web "N" fed to the machine 100, thereby making the tubular wrappers "T" to be processed by the filling unit 10.

Looking in more detail, the machine 100 comprises a feed hopper 30 configured to contain a plurality of multiple tubular segments and to feed them to a train of drums 31 by which the multiple tubular segments are cut into single tubular segments which are spaced apart and placed one after the other in such a way as to make a succession of single tubular segments whose main axis of extension "X" is disposed perpendicularly to the feed direction of the succession of segments.

The machine 100 also comprises a processing station for processing the web "N" of wrapping material and configured to receive a continuous web "N" and to cut it into a succession of connecting strips of wrapping material which are then suitably gummed so they can subsequently be fixedly coupled to the tubular segments.

It should be noted that the web "N" may be of different types, including a single layer of paper or a multilayer material such as, for example, a metal foil and paper laminate. The web "N" may have predetermined porosity for permeability to air or it may be provided with perforations to allow air to pass. The perforations may be made prior to feeding it or in-process while it is being unwound in the machine 100, by specific perforating means of known type, not illustrated, such as laser devices or mechanical perforators, for example.

The forming station 20 then comprises a first feed drum 23, configured to receive the succession of single tubular segments from the train of drums 31, and a second feed drum 24, configured to receive the succession of connecting strips from the processing station.

The first and second drums, 23, 24 then feed the succession of tubular segments and the succession of connecting strips, respectively, to a rolling drum 25, in such a way that each connecting strip is applied to a respective tubular segment in "flag-like manner".

The rolling drum 25 comprises a rolling bed 25*a* configured to wrap each connecting strip round the respective tubular segment, thus making the succession of tubular wrappers "T" which can be fed out of the forming unit 20 and into the filling unit 10.

To be able to check that the filling unit 10 has carried out operations correctly and that the products fed out of the filling machine 100 meet the quality criteria needed to allow the product to be successfully marketed, the machine 100 comprises, downstream of the filling unit 10, an inspection unit 50 that comprises at least one detector configured to detect one or more properties of the tubular wrappers filled and closed by the filling unit 10.

The detectors of the inspection unit 50 may be electromagnetic or mechanical and are adapted, by way of non-limiting example, to measure the degree of air permeability of the tubular wrappers.

Advantageously, the machine 100 may comprise perforating means adapted to perforate the closing element 101 to allow air to pass through the tubular wrapper "T" without losing the filling material by letting it fall out.

Advantageously, the machine 100 of this invention allows processing a wide range of materials to make a wide variety of sub-units of the tobacco industry.

The invention claimed is:

1. A filling unit for filling a succession of tubular wrappers of the tobacco industry, each of the tubular wrappers extending along a main axis of extension and internally defining a containment chamber adapted to contain a filling material of the tobacco industry, the unit comprising:

a filling station comprising a plurality of filling devices configured to insert the filling material into respective containment chambers of the succession of tubular wrappers through filling ends of the tubular wrappers;

a closing station disposed downstream of the filling station and comprising a plurality of closing devices configured to make respective closing walls which close the filling ends and which are transverse to the respective main axes of extension;

wherein the closing station comprises at least one feed drum on which the plurality of closing devices is mounted.

2. The filling unit according to claim 1, comprising a further closing station, disposed upstream of the filling station and comprising a plurality of further closing devices configured to make a wall for closing respective blocking ends, opposite to the filling ends, of the succession of tubular wrappers.

3. The filling unit according to claim 2, wherein each of the closing station and the further closing station comprises at least one of the at least one feed drum which, comprises a fixed cam and on which the plurality of closing devices are mounted, the closing devices each comprising a drive rod which is slidable in a respective linear guide and which is engaged with the fixed cam in such a way that as the feed drum rotates, the cam is configured to cause a to-and-fro translational movement of the closing devices along a direction parallel to the main axes of extension of the succession of tubular wrappers as the tubular wrappers pass through the respective closing station.

4. The filling unit according to claim 1, wherein the filling station comprises at least one feed drum which comprises a fixed cam and on which the plurality of filling devices are mounted, the filling devices each comprising a drive rod which is slidable in a respective linear guide and which is engaged with the fixed cam in such a way that as the feed drum rotates, the cam is configured to cause a to-and-fro translational movement of the filling devices along a direction parallel to the main axes of extension of the succession of tubular wrappers as the tubular wrappers pass through the filling station.

5. The filling unit according to claim 1, wherein the closing station is configured to fold respective filling or blocking ends of the succession of tubular wrappers in such a way as to make the respective closing walls.

6. The filling unit according to claim 5, wherein the plurality of closing devices comprises a plurality of forming devices configured to apply on respective filling or blocking ends a pressure whereby end portions of the respective ends are mechanically deformed in such a way as to make the respective closing walls.

7. The filling unit according to claim 6, wherein the plurality of closing devices comprises a plurality of pre-forming devices, disposed upstream of the plurality of forming devices and configured to permanently pre-form the respective filling or blocking ends in such a way as to make a plurality of easy fold lines disposed radially around the main axes of extension and suitable for allowing final forming and closure at a subsequent stage.

8. The filling unit according to claim 5, wherein the closing station and the further closing station are configured to fold the filling end and the blocking end of the tubular wrapper, respectively, thereby making the respective closing walls which are transverse to the main axis of extension.

9. The filling unit according to claim 8, wherein at least one chosen from the closing station and the further closing station is configured to apply a separate closing element to respective filling or blocking ends of the succession of tubular wrappers in such a way as to make the respective closing walls.

10. The filling unit according to claim 9, wherein the plurality of closing devices comprises a plurality of applicator devices configured to apply a separate closing element on respective filling or blocking ends.

11. The filling unit according to claim 10, wherein the applicator devices are configured to insert the closing elements inside the tubular wrappers.

12. The filling unit according to claim 10, wherein the applicator devices are configured to apply the closing elements outside the tubular wrappers.

13. The filling unit according to claim 12, wherein the applicator devices are configured to apply connecting strips to fix the closing elements stably to the tubular wrappers.

14. The filling unit according to claim 9, wherein the closing station and the further closing station are configured to apply separate closing elements on the filling ends and on the blocking ends of the tubular wrappers, respectively, thereby making the respective closing walls.

15. The filling unit according to claim 8, wherein at least one chosen from the closing station and the further closing station is configured to deform respective end of the tubular wrappers and to apply separate closing elements on the respective ends of the tubular wrappers in such a way as to make the respective closing walls.

16. The filling unit according to claim 15, wherein the plurality of closing devices comprises:

a plurality of applicator devices configured to apply separate closing elements on respective filling or blocking ends;

a plurality of forming devices each configured to apply on respective filling or blocking ends a pressure whereby an end portion of the respective ends is mechanically deformed in such a way as to make at least one blocking portion which is disposed inside the ends and which extends transversely to the main axis of extension, to define a surface for blocking the closing element at a predetermined position.

17. The filling unit according to claim 16, wherein the plurality of forming devices comprises first forming means, disposed upstream of the plurality of applicator devices and configured to make a first blocking portion, the first blocking portion being preferably defined by a narrowing of the tubular wrapper, and second forming device, disposed downstream of the plurality of applicator devices and configured to make a second blocking portion, the second blocking portion being defined by an edge bead of the tubular wrapper.

18. The filling unit according to claim 15, wherein the closing station and the further closing station are configured to deform the filling end and the blocking end of the tubular wrapper, respectively, and to apply the closing elements on the respective filling and blocking ends, thereby making the respective closing walls.

19. A filling machine of the tobacco industry, comprising:

the filling unit according to claim 1;

a forming unit disposed upstream of the filling unit and configured to make the succession of tubular wrappers.

20. The machine according to claim 19, wherein the forming unit is configured to receive a continuous tubular rod fed to the forming unit and comprises a cutting device operating on the tubular rod to divide the continuous tubular rod into the succession of tubular wrappers.

21. The machine according to claim 19, wherein the forming unit is configured to receive a continuous web of wrapping material and comprises:

a forming beam configured to progressively wrap the web to define a continuous rod;

a cutting device operating on the continuous rod to divide the continuous rod into the succession of tubular wrappers.

22. The machine according to claim 19, wherein the forming unit comprises:

a first feed drum configured to receive a succession of tubular segments fed to the first feed drum;

a second feed drum configured to receive a succession of connecting strips of wrapping material fed to the second feed drum;

a rolling drum configured to receive the succession of tubular segments fed to the rolling drum by the first drum and the succession of connecting strips fed to the rolling drum by the second drum in such a way that each connecting strip is applied to a respective tubular segment arranged as a flag on the respective tubular segment;

the rolling drum comprising a rolling bed configured to wrap each connecting strip round the respective tubular segment, thus making the succession of tubular wrappers.

23. The machine according to claim 19, wherein the forming unit is configured to receive a succession of tubular wrappers having an access opening at the filling end and a closing wall at the blocking end, the forming unit comprising a plurality of transfer drums configured to feed the succession of tubular wrappers to the filling unit.

24. The machine according to claim 19, comprising, downstream of the filling unit, an inspection unit which comprises at least one detector configured to detect at least one property of the tubular wrappers.

25. The machine according to claim 24, wherein the at least one detector is an electromagnetic or mechanical detector.

* * * * *